United States Patent [19]

Hanna

[11] Patent Number: 4,524,569

[45] Date of Patent: Jun. 25, 1985

[54] ANIMAL HALTER APPARATUS

[76] Inventor: Thomas B. Hanna, 1300 Hiram, Wichita, Kans. 67213

[21] Appl. No.: 619,140

[22] Filed: Jun. 11, 1984

[51] Int. Cl.[3] ..... B68B 1/02

[52] U.S. Cl. ..... 54/24

[58] Field of Search ..... 54/6 R, 6 A, 24

[56] References Cited

U.S. PATENT DOCUMENTS

| | | | |
|---|---|---|---|
| 280,237 | 6/1883 | Porter | 54/24 |
| 1,136,693 | 4/1915 | Mertz | 54/24 |
| 1,633,268 | 6/1927 | Nelson et al. | 54/24 |
| 2,114,178 | 4/1938 | Crandall | 54/24 |
| 3,407,568 | 10/1968 | Henry | 54/24 |

*Primary Examiner*—Robert P. Swiatek

*Attorney, Agent, or Firm*—Phillip A. Rein

[57] ABSTRACT

This invention relates to an animal halter apparatus to be attached to a head portion of an animal such as a horse, cow, donkey, etc., and includes (1) a nose support assembly; (2) a head support assembly secured to the nose support assembly; (3) a control ring assembly attached to a portion of the head support assembly; and (4) a jaw support assembly secured to the control ring assembly and additionally to a portion of the head support assembly. The main portion of this invention is directed to the control ring assembly and the jaw support assembly. The control ring assembly is a connector structure having a main support body integral with an inclined connector section and outer parallel aligned, end portions. The control ring assembly is of an unusual shape and design in having the inclined connector section so as to direct forces thereupon to prevent the pulling apart and destruction of the animal halter apparatus of this invention. The other features of the invention are the jaw support assembly having first and second jaw strap members which are connected by an anchor section to the control ring assembly in a unique manner. The first and second jaw strap members include jaw sections which are adapted to contact and support a jaw portion of the animal utilizing this invention.

7 Claims, 5 Drawing Figures

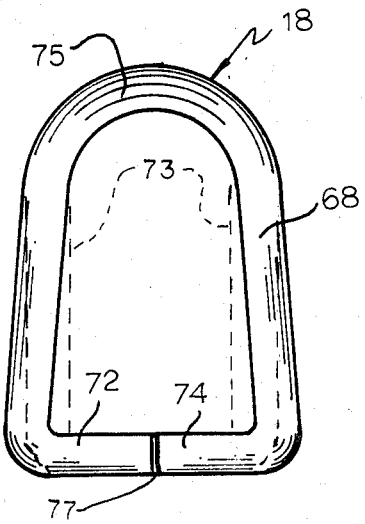
Fig 1
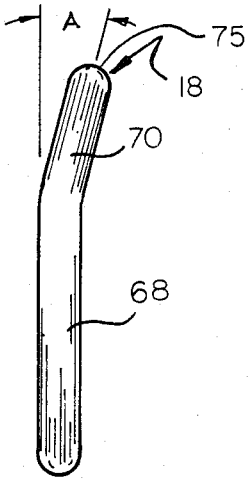
Fig 2
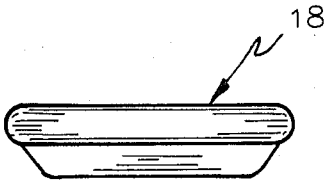
Fig 3
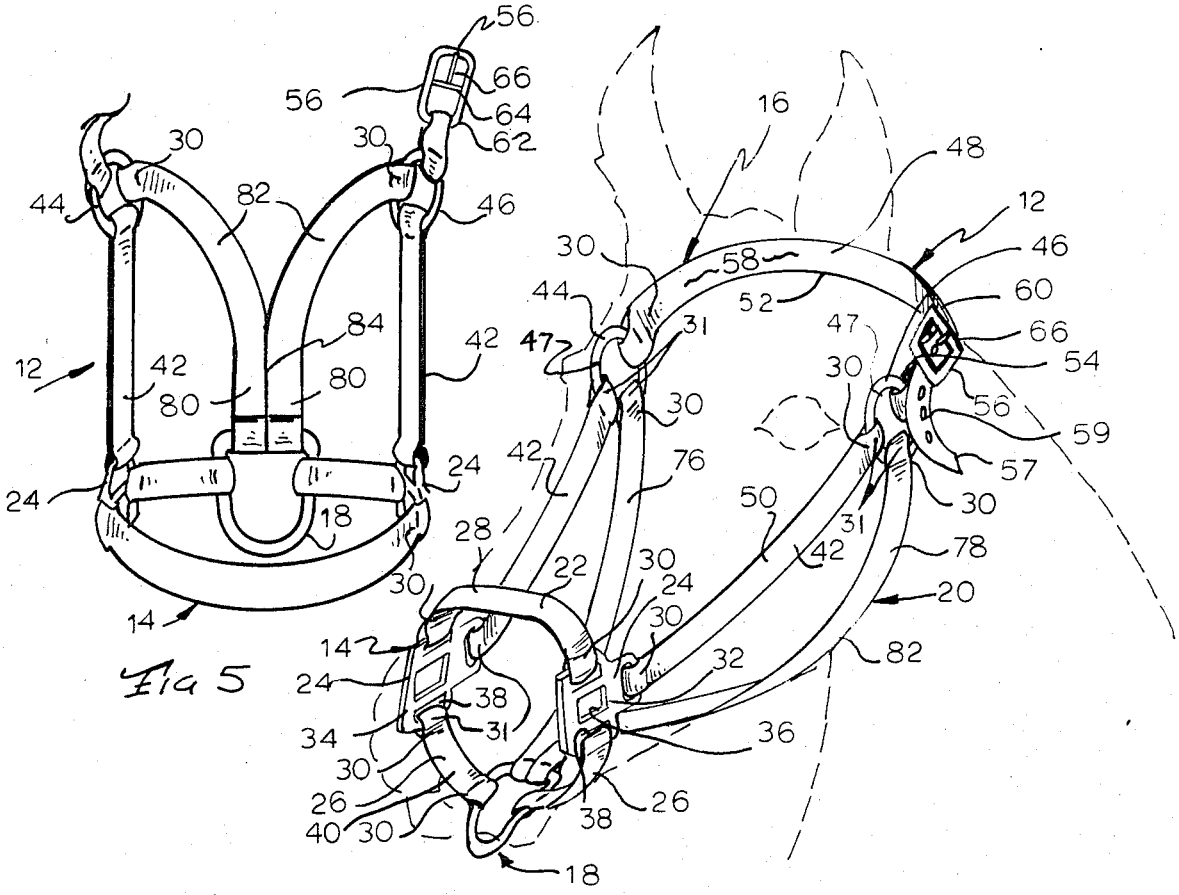
Fig 5
Fig 4

ANIMAL HALTER APPARATUS

PRIOR ART

The applicant herein is skilled in the area of manufacture and sale of animal control devices and, more specifically, the animal halter apparatus of this invention. Therefore, a patentability investigation was not conducted on this invention as it is believed that the animal halter apparatus of this invention is substantial improvement over the prior art having patentable subject matter.

PREFERRED EMBODIMENT OF THE INVENTION

In one preferred embodiment of the invention, an animal halter apparatus is set forth herein and illustrated as utilized on a horse but such halter apparatus could be utilized on other types of domestic and wild animals such as cows, donkeys, deers, bulls, etc. The animal halter apparatus of this invention includes (1) a nose support assembly; (2) a head support assembly connected to the nose support assembly and extended over and behind an animal's ears; (3) a control ring assembly connected to a portion of the nose support assembly; and (4) a jaw support assembly extended between the control ring assembly and the head support assembly. The nose support assembly is of a substantially conventional circular structure to be placed about the animal's nose portion having lower chin strap members connected to the control ring assembly. The head support assembly is of a substantially conventional nature having spaced parallel head support strap members connected from the nose support assembly to a head strap assembly. The head strap assembly includes a buckle member which is the means for releasably connecting the entire structure to the animal's head portion. The jaw support assembly includes first and second strap members which are connected at a lower anchor section to a portion of the control ring assembly and extend rewardly and outwardly to be joined to respective sides of the head support assembly. The jaw support assembly includes first and second jaw strap members having the central anchor section joined together which presents a novel feature of this invention. The control ring assembly presents a major new and novel feature of this invention being of sturdy construction and having a main support body with an integral inclined anchor section and parallel aligned connector end portions. The particular contour and shape of the control ring assembly is important as it adds substantial strength to the animal halter apparatus by not using a normal circular, connector ring at this location.

OBJECTS OF THE INVENTION

One object of this invention is to provide an animal halter apparatus which can be readily attached to the head portion of animals and provides for a sturdy control connector ring assembly so that the halter structure will not come apart on the subject animal pulling thereon with a great amount of pressure.

One other object of this invention is to provide an animal halter apparatus having a new and novel jaw support assembly which goes underneath and around the animal's jaw portion to provide substantial support thereto.

Still, one further object of this invention is to provide an animal halter apparatus having a connector control ring assembly to which a rope is attached for leading or anchoring the subject animal and the control ring assembly is of superior design to prevent the animal halter apparatus from pulling apart which normally renders the subject structure inoperable and is, thus, discarded.

Still, another object of this invention is to provide an animal halter apparatus which is economical to manufacture, sturdy in construction, attractive in appearance, substantially maintenance free, and easy to use.

Another object of this invention is to provide an animal halter apparatus which will not pull apart and, thus, last the life of the materials used in construction.

Various other objects, advantages, and features of the invention will become apparent to those skilled in the art from the following discussion, taken into conjunction with the accompanying drawings, in which:

FIGURES OF THE INVENTION

FIG. 1 is a bottom plan view of a control ring assembly of the animal halter apparatus of this invention;

FIG. 2 is a side elevational view of the control ring assembly;

FIG. 3 is a front elevational view of the control ring assembly;

FIG. 4 is a perspective view of the animal halter apparatus of this invention as shown mounted on a horse which is illustrated in dotted outline; and FIG. 5 is a front prospective view of the animal halter apparatus of this invention having portions thereof broken away.

The following is a discussion and description of one preferred specific embodiment of the animal halter apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, an animal halter apparatus of this invention, indicated generally at 12, includes (1) a nose support assembly 14; (2) a head support assembly 16 connected to the nose support assembly 14; (3) control ring assembly 18 connected to a portion of the nose support assembly 14; and (4) a jaw support assembly 20 which is connected to the control ring assembly 18 and a portion of the head support assembly 16.

The nose support assembly 14 is of generally circular shape adapted to be placed around a nose portion of an animal utilizing this invention. The nose support assembly 14 includes an upper nose support strap member 22 interconnected at opposite ends to side connector members 24 which, in turn, are connected to spaced chin strap members 26. The nose strap member 22 includes a main body section 28 integral at opposite ends with respective loop end sections 30. The loop end sections 30 are formed by taking an end portion 31 and, after passing the end portion 31 through a portion of the respective side connector member 24, it is stitched to itself to form a closed support loop.

The side connector members 24 are of a heavy duty construction and includs a main connector body section 32 having a plurality of integral, namely three, strap connector sections 34. The connector body section 32 is provided with a generally square or rectangular central opening 36 to be utilized for various purposes as will be described.

The strap connector sections 34 are generally of rectangular shape having a strap opening 38 therein. The strap openings 38 are used for connection to the loop end sections 30 as noted in the drawings.

The chin strap numbers 26 are each identical having a chin body section 40 with outer ends thereof formed into the loop end sections 30. The subject loop end sections 30 are secured to the respective strap connector sections 34 and, at the opposite ends thereof, to the control ring assembly 18 as will be explained.

The head support assembly 16 includes (1) parallel head support strap members 42 connected at a lower end to the respective side connector members 24; (2) connector ring members 44, 46 connected at the upper end to the respective head support strap members 42; and (3) a head strap assembly 48 which is releasably connectable between the connector rings 44, 46. The head strap assembly 48 is the means for releasably attaching the invention to the head portion of the animal utilizing same. The parallel, head support strap members 42 are each provided with a jaw body section 50 and having integral, at opposite ends thereof, loop end sections 30 for connection to the various parts as shown in FIGS. 1 and 5.

The connector ring members 44, 46 are of a generally circular shape having opposite end portions 47 secured together as by welding. The connector ring members, 44, 46 are of a conventional nature normally constructed of a 7/16 inch diameter material.

The head strap assembly 48 includes (1) a connector strap member 52 having one end thereof secured to the connector ring member 44; (2) an anchor strap member 54 having one end portion connected to the connector ring member 46; and (3) a buckle member 56 which is connected to an outer end of the anchor strap member 54 and releasably connectable to the connector strap member 52. The connector strap member 52 includes a connector body section 58 having a loop end section 30 at one end connected to the connector ring member 44 and a connector section 57 at the other end. The connector section 57 is provided with a plurality of spaced connector holes 59 for attachment to the buckle member 56 as will be explained.

The anchor strap member 54 includes a buckle section 60 integral with a loop end section 30 which is secured to the connector ring member 46. The buckle section 60 is also formed with a loop type connection for attachment to the bukcle member 56.

The buckle member 56 includes a rectangular main body 62 having a central connector shaft 64 to which is attached a pivotal anchor rod 66. The anchor rod 66 is adapted to contact the rectangular main body 62 to limit its pivotal movement after the anchor rod 66 is placed within a selected connector holes 59 when connecting the animal halter apparatus 12 of this invention to the head portion of an animal.

The control ring assembly 18 is one of the important features of this invention and includes a main support body 68 of somewhat bell shape having an inclined connector section 70 at one end. The main support body 68 at the other end is provided with adjacent axially aligned connector end portions 72 and 74. Further, the main support body 68 is provided with outwardly convergent inclined leg portions 73. The inclined connector section 70 is provided with a curved portion 75 to which is normally attached a snap connected to a lead rope for the control of the animal wearing the animal halter apparatus 12 of this invention.

The connector end portions 72 and 74 include adjacent end walls 77 secured together as by welding. The control ring assembly 18 is preferably constructed of a cylindrical material such as 5/16 inch diameter which provides greater strength and durability over the material used for the connector ring members 44, 46.

The jaw support assembly 20 includes first and second jaw strap members 76, 78, each having an anchor section 80 integral with a jaw section 82. The outer ends of the anchor sections 80 and the jaw sections 82 are secured through loop end sections 30 of the respective ones of the connector ring members 44, 46.

The adjacent anchor sections 80 are extended in a common plane and have a central portion thereof interconnected at a connector portion 84 such as by stitching or the like. This provides substantial strength and allows the jaw sections 82 to fit about the jaw portion of the animal wearing the animal halter apparatus 12.

The various strap members of the invention may be constructed of canvas or, preferably, of woven plastic materials, which provide substantial strength wherein failure of the animal halter apparatus 12 normally occurs in the metal hardware pieces.

As shown in dotted lines in FIG. 1, the control ring assembly 18 may be provided with parallel leg portion 73 so that the control ring assembly 18 can be used with a conventional halter structure.

USE AND OPERATION OF THE INVENTION

In the use and operation of this invention, the animal halter apparatus 12 can be utilized on horses, cows, donkeys, deer, dogs and other such animals to attach an animal control device to the head portion of the subject animal for (1) securing as by a rope member to a desired location; or (2) leading and exercising same. It is noted that the buckle member 56 is first released from the connector strap member 52 in a conventional buckle operating manner.

Next, the nose assembly 14 is placed about a nose portion of the animal to receive this invention and the jaw support assembly 20 is placed beneath the animal's jaw portion. Additionally, the connector strap member 52 is grasped and brought behind an ear portion of the subject animal. The connector strap member 52 is then trained through the rectangular main body 62 of the buckle member 56. Then, the connector member 52 is pulsed through the buckle member 56 to a desired tightness of the nose support assembly 14 and jaw assembly 20 about the head portion of the subject animal. The anchor rod 66 is inserted through a selected connector hole 59 and the remaining portion of the connector strap member 52 is trained through the buckle member 56 to anchor same as shown in FIG. 4.

It is noted that the control ring assembly 18 of this invention provides substantial rigidity to its connection to (1) the nose support assembly 14; (2) the head support assembly 16; and (3) the jaw support assembly 20 so as to prevent failure in the control ring assembly 18. Additionally, due to the unique shape of the connector control ring assembly 18 of this invention, the particular welded portion at the adjacent end walls 77 is always in the same position to be directly pulled upon by the anchor sections 80 of the first and second jaw strap members 76, 78. This is an important feature of this invention as normally a circular ring such as the connector ring members 44, 46 are utilized in this location.

The connector ring members 44, 46, are then free to rotate and the load of (1) pulling an animal, or (2) an animal tied up trying to escape may be placed directly on the welded portion to cause separation and resultant failure.

Additionally, the control ring assembly 18 is provided with an angular inclination indicated at letter "A" which also directs the pulling force of an animal substantially in line with the axis of the leg portions 73 of the control ring assembly 18 for superior strength.

The control ring assembly 18 provides a new and novel feature by preventing the separation of the loop end sections 30 from the various connecting points on the animal halter apparatus 12. This is important as, on breaking of the loop end sections 30, it requires a commercial sewing machine and the unconnecting and reconnecting of the various stitched portions of the animal halter apparatus 12 to repair same.

Also, the jaw support assembly 20 of this invention is important as the anchor sections 80 of the first and second strap members 76, 78 are connected to the end portions 72, 74 of the control ring assembly 18. On pulling back against the control ring assembly 18, joined section of the first and second strap members 76, 78 is pressed against a portion of the animal's jaw to provide substantial support and restraint on utilizing the animal halter apparatus 12 of this invention.

It is seen that the animal halter apparatus of this invention provides an attractive sturdy structure which can be utilized on numerous types of animals. The animal halter apparatus is provided with superior support characteristics plus added strength needed in holding an animal that is attempting to disengage itself from a person's control. Also, the animal halter apparatus of this invention is easy to use and maintenance free.

While the invention has been described in conjunction with preferred specific embodiments thereof, it will be understood that this description is intended to illustrate and not to limit the scope of the invention, which is defined by the following claims.

I claim:

1. An animal halter apparatus adapted to be placed about a head portion of an animal such as a horse, comprising:

(a) a nose support assembly to be placed about a nose portion of subject animal;

(b) a head support assembly secured to said nose support assembly and releasable connected about a top head portion of subject animal;

(c) a control ring assembly to interconnect adjacent portions of said nose support assembly and adapted to receive a control line thereon to move or anchor subject animal;

(d) said control ring assembly of generally bell shape having a main support body integral with a connector section and aligned end portions;

(e) said adjacent portions of said nose support assembly connected to opposed portions of said main support body whereby said control ring assembly cannot rotate thus providing a constant, rigid structure;

(f) a jaw support assembly connected to said end portions of said control ring assembly and said head support assembly; and (g) said jaw support assembly having first and second jaw strap members interconnected to each other at a section adjacent to said end portions to contact and support a jaw portion of the subject animal in a rearwardly and upwardly inclined manner from said control ring assembly to said head support assembly.

2. The animal halter apparatus as described in claim 1, wherein:

(a) said first and second jaw strap members each have an anchor section connected to each other and said end portions connected to said control ring assembly and to each other to form a substantial chin support area.

3. The animal halter apparatus as described in claim 1, wherein:

(a) said connector section is integral with leg portions and inclined downwardly and forwardly relative to said main support body to receive the control line thereon.

4. The animal halter apparatus as described in claim 1, wherein:

(a) a jaw support assembly is connected to said end portions of said control ring assembly to apply any pulling force perpendicular to aligned axis of said end portions.

5. The animal halter apparatus as described in claim 1, wherein:

(a) said control ring assembly has the control line connected to said connector section extended forwardly and downwardly of said main support body to transfer pulling force to said adjacent portions of said main support body and then to said end protions.

6. The animal halter apparatus as described in claim 1, wherein:

(a) said main support body has parallel leg portions integral with said connector section and said end portions and said connector section extended forwardly and downwardly of said main support body.

7. The animal halter apparatus as described in claim 1, wherein:

(a) said main support body has divergent leg portions integral with said connector section and said end portions and said connector section extended forwardly and downwardly of said main support body.

* * * * *